US005403447A

United States Patent [19]

Järvinen et al.

[11] Patent Number: 5,403,447

[45] Date of Patent: Apr. 4, 1995

[54] SYSTEM IN A PRESS SECTION OF A PAPER MACHINE FOR MONITORING AND CONTROL OF THE RUNNING OF THE PRESS FELTS

[75] Inventors: Jarmo Järvinen, Jyskä; Kyösti Kuukkanen, Jyväskylä; Pekka Liukkonen, Jyväskylä; Jari Tiainen, Jyväskylä, all of Finland

[73] Assignee: Valmet Paper Machinery Inc., Helsinki, Finland

[21] Appl. No.: 886,753

[22] Filed: May 21, 1992

[30] Foreign Application Priority Data

May 21, 1991 [FI] Finland ..... 912474

[51] Int. Cl.[6] ..... D21F 3/00

[52] U.S. Cl. ..... 162/358.1; 162/DIG. 10; 162/252; 162/262; 364/471; 395/904

[58] Field of Search ..... 100/48; 162/358.1, DIG. 10, 162/263, 252, 262; 364/149, 150, 151, 152, 471; 395/50, 904

[56] References Cited

U.S. PATENT DOCUMENTS

| | | | |
|---|---|---|---|
| 4,902,384 | 2/1990 | Anstotz et al. | 162/252 |
| 4,949,278 | 8/1990 | Davies et al. | 395/50 |
| 5,167,010 | 11/1992 | Elm et al. | 395/50 |

FOREIGN PATENT DOCUMENTS

| | | |
|---|---|---|
| 2025447 | 5/1991 | Canada . |
| 0151908A3 | 8/1985 | European Pat. Off. . |
| 0287276A2 | 10/1988 | European Pat. Off. . |
| 762584 | 9/1976 | Finland . |
| 69331 | 5/1984 | Finland . |
| 3719828A1 | 12/1988 | Germany . |
| 3809526A1 | 10/1989 | Germany . |
| 3152290 | 6/1991 | Japan . |

OTHER PUBLICATIONS

Fadun Ole, "An Introduction to Articial Intelligence", Mar. 1993, pp. 85–92, Pulp & Paper Magazine.

Gagnon Yvon, "Low Freq. Vibration Analysis of PM Presses Using Displ. Transducers and the Synchronous Time-av Method", Jul. 87, TAPPI Journal, pp. 49–54.

*Primary Examiner*—W. Gary Jones
*Assistant Examiner*—Dean T. Nguyen
*Attorney, Agent, or Firm*—Cohen, Pontani, Lieberman, Pavane

[57] ABSTRACT

System in a press section of a paper machine for monitoring and control of the running of the press felts (10,20,30). The press felts (10,20,30) are guided by means of rolls (13,14,15; 23,24,25; 33,34, 35), whose axial directions are altered by means of an actuator (**18*a*, 18*b*) so as to control the running of the press felts (10,20,30). The system includes detector devices (16,26,36), by whose means the alignment stripe (K) on the felt or felts (10,20,30) is detected, as well as oscillation detectors (17,27,37), by whose means oscillations of the press rolls (10, 20,30) are detected. Into the computer part (50) included in the system, the monitoring signals (a,b) are fed from said detectors (16,26,36, 17,27,37). The computer (50) analyzes the detector data in order to detect any felt-induced oscillations. By the intermediate of a control system (40), the computer (50) regulates the actuators (18*a*, 18*b*) of the guide rolls that guide the running of the felts (10,20,30) so that, when the oscillation levels of the press rolls rise beyond certain limits, the direction of the guide roll of the felt (10;20;30**) that causes the oscillation is turned until an acceptable level of oscillation and/or a level of oscillation as low as possible is found.

11 Claims, 3 Drawing Sheets

SYSTEM IN A PRESS SECTION OF A PAPER MACHINE FOR MONITORING AND CONTROL OF THE RUNNING OF THE PRESS FELTS

BACKGROUND OF THE INVENTION

1. Field of the Invention

The invention concerns a system in a press section of a paper machine for monitoring and control of the running of the press felts, which press felts are guided by means of rolls, whose axial directions are arranged so that they can be altered by means of an actuator so as to control the running of the press felts, and which system includes detector devices, by whose means the alignment stripe on the felt or felts is detected, and which system includes a computer or a corresponding logic unit, into which the monitoring signals are fed from the detectors in the system.

2. Description of the Prior Art

As is well known, the presses in paper machines comprise press rolls, which form press nips with each other, through which nips the paper web runs together with a press felt or felts. The press rolls with their axle journals and beating brackets are susceptible of oscillations, which tendency is increased by the elasticity of the press felts. In press rolls, auto-oscillations occur commonly, which are typically in a frequency range of 20 . . . 150 Hz. These oscillations produce noise and affect the quality of the paper web produced, because the oscillations, especially oscillations taking place in the nip plane, produce variations in the compression pressure in the nip. Further, the oscillations produce shrinkage and wave-like barring in the press felts and undue wear of the felts. Said barring tends to increase the so-called felt-induced oscillation of the press rolls, and when the wave-like barring in the felts becomes deeper, the amplitude of said oscillation tends to increase constantly.

Said felt-induced oscillations occur mainly at the harmonic frequencies $f_N = N \cdot v/L$, wherein N=an integer, v=felt velocity, and L=overall length of felt loop. When oscillations are noticed in the press section at said different "resonance frequencies" $f_N$, it can be concluded that felt-induced oscillations are concerned, which are derived from said very felt whose length is L and velocity v.

Attempts have been made to prevent felt-induced oscillations of press rolls thereby that the running direction, i.e. the "splice", of the felt is, at suitable intervals, turned by a few angle degrees so that the felt runs over the spreader, tensioning and alignment rolls (in the following, the general denotation "guide roll" will also be used for these rolls) in slightly varying positions. Said splice turning means that the felt loop runs in a slightly diagonal position, i.e. the length of one of its edges is somewhat larger than the length of the opposite edge. This means that any transverse stripes and bars that may be formed in the felt do not run through the press nips exactly as parallel to the longitudinal directions of the nips but at a small angle diagonally, in which case, when the bar or stripe runs through the nip, it does not induce an oscillation of a detrimentally high amplitude in the press rolls.

The prior-art felt-splice turning systems have, as a rule, been based on the experience acquired by the operating personnel in practice. Manual felt guide systems require constant alertness from the operating personnel. It is often difficult to judge how frequently the axial alignment of the felt guide rolls must be changed, i.e. the "splice" be turned. Moreover, by means of the manual control systems, it cannot even be found out with certainty whether the control operation is of the right direction, i.e. whether it increases or reduces the oscillations in the press rolls. Since the experience and the professional skill of the operating personnel vary and the properties and the qualities of the press felts change, by means of manual felt control and splice-turning, a sufficiently good result has not been achieved in respect of the quality of the paper produced and in respect of the wear of the various components in the press section, such as the felts, press rolls, and their bearings.

In order to avoid the drawbacks discussed above and in view of further development of the manual control systems, some press-felt splice-turning systems have been suggested, which are to some extent automatic and/or which are based on oscillation measurements, and in respect of said systems, reference is made, by way of example, to the FI Patent Applications Nos. 891386 and 882730 (equivalent of DE 38 09 526 and DE 37 19 828.9). According to the latter application, the press-felt splice turning takes place as timed by a switch clock or as linked with the measured level of oscillation. The oscillation criterion is a band-pass filtered and rectified signal, which involves the drawback that the factual source of the oscillation at different running speeds of the machine cannot be identified.

In the splice-turning systems discussed above and in other, corresponding systems, there are several needs of development, for example, because the splice turning takes place constantly or at certain fixed time intervals, so that the splice cannot be turned optimally and in accordance with a need that varies in respect of time. For example, with a new felt there is a necessity to turn the splice more frequently. The most important drawbacks in the systems in accordance with the above FI applications are therein that it cannot be concluded with which felt the particular oscillations are in phase and that, by means of the systems, the factual running position of the felts cannot be noticed or measured.

SUMMARY OF THE INVENTION

The principal object of the present invention is further development of the prior art described above so that the quality of the paper produced can be improved further and that the wear of the various components in the press section, such as the press rolls and their bearings and the press felts, can be reduced and their service lives be increased.

It is a particular object of the invention to provide a novel splice-turning system by whose means the barring and shrinkage of the press felts can be prevented by running the felts under control and optimally right from the beginning of their use. The aim of this optimal running is to keep the levels of the felt-induced oscillations at the minimum in all different situations of operation.

An object of the present invention is to provide a splice-turning system into which the individual parameters that affect the splice turning can be fed separately so that in each particular situation of operation, for example in connection with replacements of felts, changes in roll diameters, replacements of bearings, or with various modification works, optimal splice-turning sequences are always achieved.

It is a further object of the invention to provide a system in which it is possible, when necessary, to provide and to program a certain hysteresis for the change and alarm limits and a suitable follow-up time for exceeded alarm limits so that the effects of irrelevant oscillations and unnecessary splice turnings can be eliminated.

In view of achieving the objectives stated above and those that will come out later, the invention is mainly characterized in that the detectors in the system include oscillation detectors, by whose means oscillations of the press rolls and/or of components related to them are detected, that said computer or equivalent is programmed to analyze the detector data especially in order to detect any felt-induced oscillations, that said computer or equivalent, by the intermediate of a control system connected to it, regulates the actuators of the guide rolls that guide the running of the felts so that, when the oscillation levels of the press rolls rise beyond certain limits, the direction of the guide roll or guide rolls of the felt that causes the oscillation is turned until an acceptable level of oscillation and/or a level of oscillation as low as possible is found, that the programs of the computer or equivalent and of the control unit in the monitoring and control system have been fitted as an intelligent expert system, into which a process model of the oscillation system of the press section has been assembled, and that into said process model new parameter data can be fed when substantial changes related to the oscillation system take place in the process.

According to the present invention, a system for the control and monitoring of the running of the press felts has been provided, in which, in the software of the computer or a corresponding logic and of the control system employed in the system, the required data can be assembled as a sort of a process model or expert system, by whose means the control of the press felts can be arranged so that the quality of the paper produced is optimal with regard to the oscillations of press rolls dependent on the control of the felts while the wear of the felts and of the other components has been minimized. For the purpose described above, new process parameters can be fed into the expert system when, for example, felts or press rolls are replaced, when the running of a felt is altered, or when other modifications related to the oscillation system are carried out.

It is an essential novel feature of the invention that the felt-guide and splice-turning system carded out in accordance with the invention can be arranged "intelligent" in the respect that the system is capable of analyzing from which felt the oscillations that occur at each particular time are derived. This is based on detection of the frequencies $f_N$ discussed above, which are harmonic in relation to the time taken by the cycle of the felt loop. The felt cycle times are found out by means of the detectors or series of detectors employed in the invention and detecting the by-passing of the identification stripes in the felt. Moreover, when optical detector series are employed, it is also possible to find out the direction and even the form of said identification stripes, on which basis it is also possible to determine the running direction and/or the state of tension of each felt.

In the following, the invention will be described in detail with reference to some exemplifying embodiments of the invention illustrated in the figures in the accompanying drawing, the invention being by no means strictly confined to the details of said embodiments.

DETAILED DESCRIPTION OF THE PREFERRED EMBODIMENTS

Figure 1:
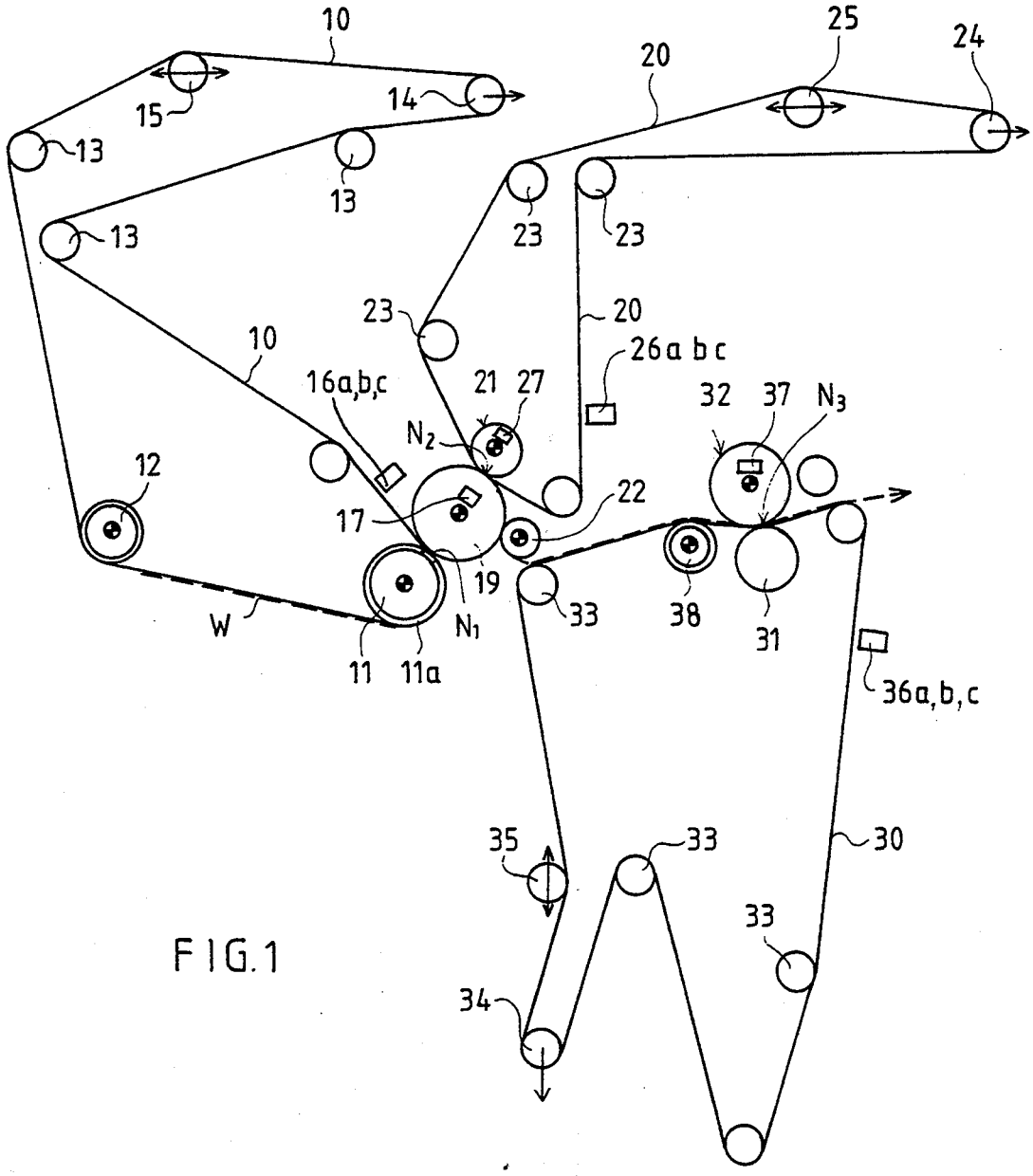
FIG. 1 is a schematic side view of a press section in which the felt-guidance and the splice-turning in accordance with the invention are applied as well as of a related control and data-processing system.

The press section shown in FIG. 1 and its geometry are primarily known in prior art, and they will be described in this connection just for an understanding of the background and the environment of application of the invention and as an example. The paper web W arrives from the web former (not shown) of the paper machine and is transferred from the pick-up roll 12 onto the first press felt 10, which runs through the first dewatering nip $N_1$. The first nip $N_1$ is formed between a press roll 11 provided with a suction zone 11*a* and a smooth-faced centre roll 19. In connection with the centre roll 19, the second press nip $N_2$ is formed together with the press roll 21. The second press felt 20 runs through the second nip $N_2$. The third nip $N_3$ in the press section is separate, being formed between a smooth-faced upper roll 32 and a hollow-faced lower roll 31. The web W that is pressed is separated on the transfer roll 22, being carried on the top face of the third press felt 30 over the suction roll 38 into the third nip $N_3$, after which the web W is separated from the third felt 30 and is transferred to the drying section of the paper machine (not shown).

The closed loop of the first felt 10 is guided by the spreader rolls 13, the tensioning roll 14, and the alignment roll 15. Likewise, the second felt 20 is guided by the spreader rolls 23, the tensioning roll 24, and the alignment roll 25. In a corresponding way, the third felt 30 is guided by the spreader rolls 33, the tensioning roll 34, and the alignment roll 35. In connection with the loops of the upper felts 10 and 20, there are series of optical detectors 16*a*, 16*b*, 16*c* and 26*a*, 26*b*, 26*c*, by whose means the by-passing and the position of the mark stripes K, i.e. of the splice, on the felts 10;20 are detected. In a corresponding way, in connection with the loop of the lower felt 30, them is a series of optical detectors 36*a*, 36*b*, 36*c* for the purpose stated above. As a rule, there is one of said mark stripes K on each felt loop. In connection with the axle journals and/or the bearing brackets of the press rolls 19,21;32, there are, both at the operating side and at the driving side of the machine, oscillation detectors 17;27;37, which are arranged to measure preferably both the radial oscillation and the axial oscillation of the press rolls.

Figure 2:
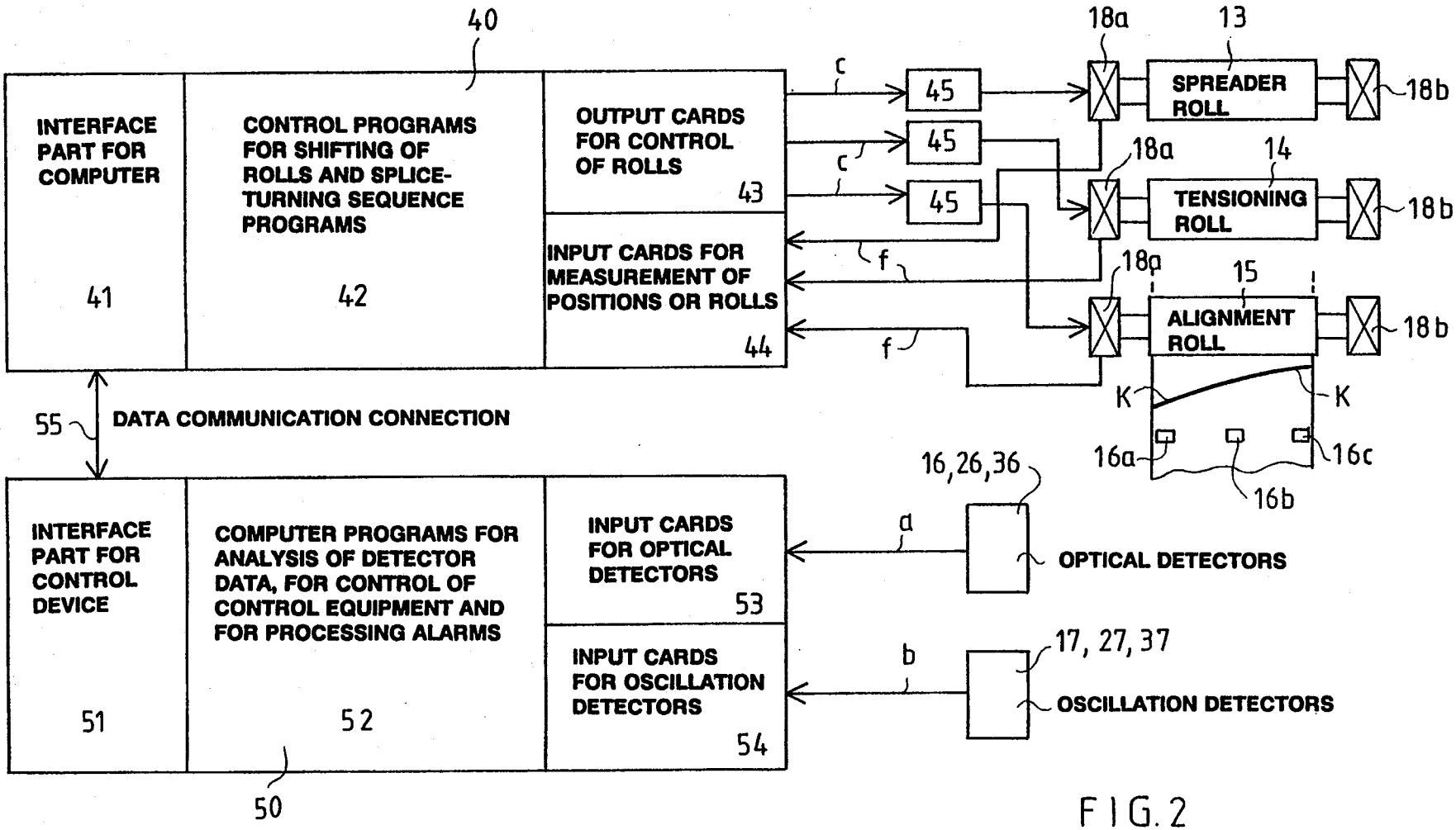
FIG. 2 is a schematic illustration, substantially as a block diagram, of a system in accordance with the invention for the control and monitoring of a felt and of the connection of said system with the actuators of the press-felt guide rolls.

According to FIG. 2, in connection with the axle journals of the rolls 13,14,15; 23,24,25;33,34,35, which affect the running and the control of the felts 10;20;30, there are actuators 18*a*, 18*b*, by whose means the axial alignment of said rolls can be changed within certain limits and the splice of the felts 10,20,30 be turned.

In the following, the main principles of the operation of the splice-turning system described above will be described.

According to FIG. 2, the optical detectors 16,26,36 placed in connection with the felts 10,20,30, or corresponding series of detectors 16a,16b,16c;26a,26b,26c;-36a, 36b,36c, notify the computer 50, as a signal a, of the by-passing and the position of the mark stripes K on the felts, i.e. of the phase and position of the running of the felt. The signal a is passed to the input circuits 53 of the computer 50, which circuits convert the analogical signals to digital signals. In a corresponding way, the oscillation detectors 17,27,37 placed in connection with the press rolls 11,21,31 notify the computer 50, as a signal b, by the intermediate of the input circuits 54, of the states of oscillation of the press rolls. In the computer 50, the block 52 represents the programs for the analysis of the detector data a,c, for the control of the control equipment, and *for the processing of alarms. Further, the computer 50 includes an interface part 51, which communicates, through a data communication connection 55, with the control unit 40 of the felt control and monitoring system.

On the basis of the intelligence of its program, the computer 50 is capable of analyzing, for example, from which felt the oscillations are derived, by means of the harmonic frequencies $f_N$ mentioned above. For example, the nips $N_1$ and $N_2$ are connected with each other by the intermediate of the centre roll 19, and it must be possible to distinguish between the felt-induced oscillations produced by the felts 10 and 20.

The control unit 40 is provided with an interface part 41, through which the control unit 40 communicates with the computer 50. The control unit 40 includes the control programs for the turning of the guide rolls and equivalent and the programs of splice-turning sequences, which are represented by the block 42. Further, the control unit 40 includes the output circuits 43 for the control of the rolls as well as input circuits 44 for measurement of the positions of the rolls. By the intermediate of the output circuits 43, regulation signals c are given to the regulators 45, which control the actuators 18a (18b) of the rolls 13,14,15;23,24,25;33,34,35, by means of which actuators the alignments of said rolls are turned, and thereby the splices of the felts 10,20,30 are turned. From the actuator 18a (18b), feedback signals f are received, which are passed through the input circuits 44 to the control system 40 for the measurement of the positions of the rolls.

In the way described above, an intelligent expert system has been provided, in which, in the software of the computer 50 and of the control system 40, essential knowledge has been assembled which is necessary in order to keep the levels of the felt-induced oscillations in the press as low as possible. When the level of the oscillations detected by means of the oscillation detectors 17,27,37 rises beyond a preset limit, the computer 50 seeks, on the basis of its program, the next and the subsequent further sequence until a sufficiently low level of oscillation of the press rolls is reached. If an acceptable level of oscillation is not found, the operating personnel is given an alarm. In the latter case, the computer 50 seeks the sequence with which the lowest levels of oscillation are reached and continues the running of the felt on the basis of this criterion of oscillation.

After the alignment of the felt guide rolls has been changed or after an alarm limit has been exceeded, the system monitors the situation for a period of 5–10 minutes before issuing splice-change commands.

The monitoring and control system described above and the related computer programs or corresponding control algorithms form a sort of a "process model", by whose means the duty of optimization of the invention can be solved. In this process model it is appropriate to allow certain parameters to remain open parameters to be fed into the model, the values of said parameters being changed when felts or press rolls are replaced and/or when the paper quality that is produced and/or the nip pressures are changed. The data fed into the process model can include diameters of the rolls of the nips, the bearings and other factors which might produce oscillations in a monitor frequency band. This helps avoid unnecessary splice turnings.

Figure 3:
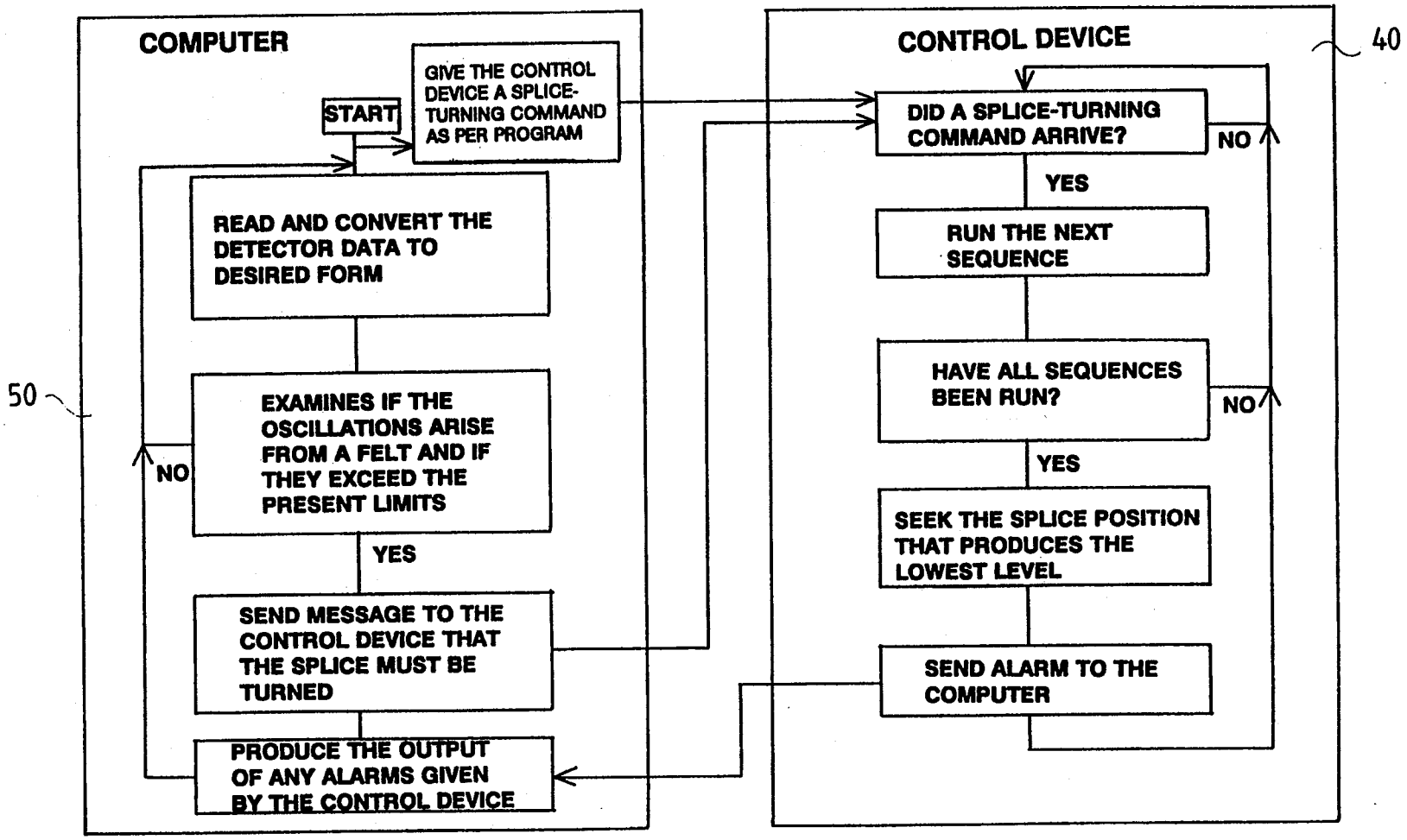
FIG. 3 shows an exemplifying embodiment of the program of the computer and the control device in the control system of the invention and of the various sequences of said program as a flow diagram.

FIG. 3 shows an exemplifying embodiment of the construction of the program of a computer 50 and of a control device 40. The operation of the programs illustrated in FIG. 3 with their various stages come out from the flow diagram given in FIG. 3 and from the above description, for which reason it will not be repeated here.

When a new felt 10,20 and/or 30 is installed into the press section, the system 40,50 is notified thereof, whereupon a ready-programmed splice-turning sequence for new felt is started. At the beginning, the splice of said felt is turned, e.g., at intervals of about two hours, and later the splice-turning interval is made longer.

The splice-turning system in accordance with the invention can be connected to the process computer that controls the operation of the paper machine, and said process computer can be used as the computer 50. The control system 40 may also be integrated in the rest of the automation system of the paper machine.

In the following, the patent claims will be given, and the various details of the invention may show variation within the scope of the inventive idea defined in said claims and differ from what has been stated above for the sake of example only.

We claim:

1. A system in a press section of a paper machine for monitoring and controlling running of a plurality of press felts, comprising:

an alignment stripe arranged on each of the felts;

guide rolls arranged so as to guide the press felts, said guide rolls having respective axial alignment;

actuator means for altering the axial alignment of the guide rolls so as to control the running of the press felts;

press rolls for pressing the felts;

detectors for detecting passing of the alignment stripes of the felts and putting out corresponding monitoring signals;

oscillation detectors for detecting oscillation of said press rolls and outputting corresponding signals;

computer means for receiving the signals from said alignment stripe detectors and analyzing the signals to detect felt-induced oscillations, and further, by utilizing harmonic oscillation frequencies $f_N = N.v/l$, wherein N equals an integer, v equals speed of a felt inducing oscillation, and l=overall length of the felt loop, determining from which felt the oscillation is derived; and control means connected to said computer means for regulating said actuator means so that when oscillation levels of ally of the press rolls rises above a certain limit, the alignment of the guide roll causing the oscillation is turned until an acceptable level of oscillation is reached, the control means and the computer means being combined to form an intelligent expert system into which a process model of all oscillation system of the press section is assembled and stored, new parameter data being feedable into said process model when substantial changes related to the oscillation system take place.

2. A system as defined in claim 1, wherein at least two of said alignment stripe detectors are placed side by side so that by-passing of the alignment stripe and a direction of the alignment stripe are detected, when more than two alignment striped detectors are used alignment stripe form is also detectable.

3. A system as defined in claim 2, wherein said alignment stripe detectors are optical detectors.

4. A system as defined in claim 3, wherein said computer means includes input circuits for the optical detectors and the oscillation detectors, and an interface for connecting the computer means with the control means, said computer means and the system being controlled by a program which analyzes the signals arriving from said detectors and gives monitoring and control signals to the control means.

5. A system as defined in claim 1, wherein said actuator means puts out feedback signals relating to the alignment of the guide rolls, said control means including an interface by means of which the control means communicates with the computer means, said control means further including output circuits which put out a regulation signal for regulating said actuator means to turn the alignment of the guide rolls, said control means still further including input circuits to which the feedback signals from said actuator means are passed for measurement of the position of the rolls, operation of said control means being controlled by a sequence program for roll shifting and splice turning.

6. A system as defined in claim 1, wherein the alignment stripe detectors are optical detectors which detect by-passing of the alignment stripes of the felts, the signals from said optical detectors being used to control and determine felt-induced oscillation frequencies or frequency ranges of the press rolls, when the levels of oscillation of the press rolls rise beyond a certain limit, the computer means and control means determine an alignment of the felt guide rolls that produces at least one of an acceptable oscillation and a lowest level of oscillation based upon sequences controlled by the system.

7. A system as defined in claim 6, wherein said optical detectors detect alignment of the alignment stripes.

8. A system as defined in claim 1, wherein the issuance of a splice-change command is delayed approximately 5–10 minutes, at least one of after alignments of the felt guide rolls have been changed and after an alarm limit has been exceeded.

9. A system as defined in claim 1, wherein the press section includes press nips with rolls and bearings, the data feedable into said process model including data concerning diameters of the rolls of the press nips, the bearings, and additional corresponding factors that may produce oscillations within a frequency band to be monitored, so as to prevent unnecessary splice turnings.

10. A system as defined in claim 1, wherein the paper machine includes a process computer and an automation means, the system being connected to at least one of the process computer of the paper machine and the automation means of the paper machine.

11. A system as defined in claim 1, wherein said computer means more frequently changes alignments of the guide rolls that guide the felt after installation of a new press felt than towards an end of service life of said press felt.

* * * * *